US012234823B2

(12) United States Patent
Kokabu et al.

(10) Patent No.: US 12,234,823 B2
(45) Date of Patent: Feb. 25, 2025

(54) INTERNAL GEAR PUMP AND INTERNAL GEAR MOTOR

(71) Applicant: SHIMADZU CORPORATION, Kyoto (JP)

(72) Inventors: Takuya Kokabu, Kyoto (JP); Koichi Osamura, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 18/569,804

(22) PCT Filed: Mar. 9, 2022

(86) PCT No.: PCT/JP2022/010369
§ 371 (c)(1),
(2) Date: Dec. 13, 2023

(87) PCT Pub. No.: WO2023/281821
PCT Pub. Date: Jan. 12, 2023

(65) Prior Publication Data

US 2024/0280098 A1 Aug. 22, 2024

(30) Foreign Application Priority Data

Jul. 5, 2021 (JP) ..... 2021-111748

(51) Int. Cl.
*F04C 2/10* (2006.01)
*F04C 2/08* (2006.01)
*F04C 15/00* (2006.01)

(52) U.S. Cl.
CPC ..... *F04C 2/102* (2013.01); *F04C 2/084* (2013.01); *F04C 2/101* (2013.01); *F04C 15/0026* (2013.01)

(58) Field of Classification Search
CPC ..... F04C 2/084; F04C 2/101; F04C 2/102; F04C 15/0026
See application file for complete search history.

(56) References Cited

U.S. PATENT DOCUMENTS 4,132,514 A * 1/1979 Eckerle ..... F04C 2/101 418/170
6,183,229 B1 * 2/2001 Friedmann ..... F04C 2/101 418/170

FOREIGN PATENT DOCUMENTS

JP S5430506 A 3/1979
JP H04203373 A 7/1992
(Continued)

OTHER PUBLICATIONS

International Search Report mailed on May 10, 2022, in corresponding International Application No. PCT/JP2022/010369, 4 pages.
(Continued)

*Primary Examiner* — Theresa Trieu
(74) *Attorney, Agent, or Firm* — Maier & Maier, PLLC

(57) ABSTRACT

An internal gear pump includes: an internal gear rotatably fitted in a body; an external gear inscribed in and meshed with the internal gear; a filler piece that partitions a liquid feeding space formed between the internal gear and the external gear into a high pressure region and a low pressure region; and a sealing member that covers both end surfaces of both the gears in a rotation axis direction and seals the liquid feeding space, in which a communication groove for communicating an enclosed space surrounded by the filler piece and a tooth groove of at least one of the gears with the high pressure region is formed, and the communication groove is formed such that a cross-sectional area communicating with the enclosed space continuously increases and
(Continued)

an increase rate thereof acceleratively increases as a rotation phase of both the gears advances.

9 Claims, 16 Drawing Sheets

(56) References Cited

FOREIGN PATENT DOCUMENTS

| | | | |
|---|---|---|---|
| JP | H11229802 | A | 8/1999 |
| JP | 2014031793 | A | 2/2014 |

OTHER PUBLICATIONS

Office Action issued on Aug. 6, 2024, in corresponding Japanese Application No. 2023-533075, 8 pages.

* cited by examiner

INTERNAL GEAR PUMP AND INTERNAL GEAR MOTOR

TECHNICAL FIELD

The present invention relates to an internal gear pump and an internal gear motor.

BACKGROUND

As a hydraulic source for industrial vehicles, construction machines, agricultural machines, and the like, an internal gear pump including a set of internal gear and external gear that mesh with each other in a casing, and a crescent (also referred to as a filler piece) that divides a liquid feeding space formed between those gears into a high pressure region and a low pressure region is used. As such an internal gear pump, in Patent Literature 1, one pressure introduction groove is provided in a cover that is a sealing member attached to side surfaces of both gears, so that an enclosed space formed between a crescent and tooth grooves of the gears communicates with the high pressure region. In the internal gear pump in which such a pressure introduction groove is formed, oil is introduced into the tooth grooves from the high pressure region through the pressure introduction groove, whereby a pressure of the oil accumulated in the tooth grooves is gradually increased as the gears rotate. As a result, vibration of side plates and noise of the pump due to rapid increase in the pressure of the oil accumulated in the tooth grooves with the rotation are reduced.

PATENT LITERATURE

Patent Literature 1: JP 4-203373 A

SUMMARY

However, for example, in an internal gear pump including one pressure introduction groove having a monotonous shape such as a linear shape, when a rotation speed of the pump is changed from low rotation to high rotation, a pressure balance in the liquid feeding space is lost, and performance and durability of the pump may be deteriorated.

As a result of intensive studies on such a problem, the present inventors have found that the conventional internal gear pump including one pressure introduction groove having a monotonous shape has a characteristic that timing of pressure rise in the tooth grooves due to the rotation is delayed in a case where the gears rotate at a high speed as compared with a case where the gears rotate at a low speed. The present inventors have further extensively conducted studies, and have found that, in the conventional internal gear pump, since there is a large difference in the timing of the pressure rise in the tooth grooves at the time of high rotation and low rotation, there is a large difference in a ratio (area) of the high pressure region in the liquid feeding space between the case of high rotation and the case of low rotation, and therefore when the rotation speed of the pump is changed, for example, from low rotation to high rotation, the ratio of the high pressure region in the liquid feeding space is greatly changed, so that the pressure balance is lost, and the performance and durability of the pump may be deteriorated. This can also be applied to an internal gear motor having a configuration similar to such a phenomenon.

Therefore, a main objective of the present invention is to reduce a difference in timing of a pressure change in tooth grooves between low rotation and high rotation in an internal gear pump and an internal gear motor.

Solution to Problem

A first aspect of the present invention relates to an internal gear pump including: an internal gear rotatably fitted in a body; an external gear inscribed in and meshed with the internal gear; a filler piece that partitions a liquid feeding space formed between the internal gear and the external gear into a high pressure region and a low pressure region; and a sealing member that covers both end surfaces of both the gears in a rotation axis direction and seals the liquid feeding space, in which a communication groove for communicating an enclosed space surrounded by the filler piece and a tooth groove of at least one of the gears with the high pressure region is formed, and the communication groove is formed such that a cross-sectional area communicating with the enclosed space continuously increases and an increase rate thereof acceleratively increases as a rotation phase of both the gears advances.

Also, a second aspect of the present invention relates to an internal gear motor including: an internal gear rotatably fitted in a body; an external gear inscribed in and meshed with the internal gear; a filler piece that partitions a liquid feeding space formed between the internal gear and the external gear into a high pressure region and a low pressure region; and a sealing member that covers both end surfaces of both the gears in a rotation axis direction and seals the liquid feeding space, in which a communication groove for communicating an enclosed space surrounded by the filler piece and a tooth groove of at least one of the gears with the low pressure region is formed, and the communication groove is formed such that a cross-sectional area communicating with the enclosed space continuously increases and an increase rate thereof acceleratively increases as a rotation phase of both the gears advances.

According to the aspect of the present invention configured as described above, since the communication groove is formed such that the cross-sectional area communicating with the enclosed space continuously increases as the rotation phase of both the gears advances, and the increase rate acceleratively increases, the amount of a hydraulic fluid (oil or the like) introduced from the communication groove into the tooth groove of the gear can be acceleratively increased with the rotation. Therefore, as compared with the conventional one in which only one monotonically shaped communication groove is formed, only the timing of the pressure change in the tooth groove at the time of high rotation can be significantly advanced without significantly advancing the timing of the pressure change in the tooth groove at the time of low rotation of both the gears. As a result, in the internal gear pump and the internal gear motor, the difference of the timing of the pressure change in the tooth groove between the time of low rotation and the time of high rotation is reduce to enable an improvement in the performance and durability of the pump.

DETAILED DESCRIPTION

[1] First Embodiment

Hereinafter, an internal gear pump 100 according to a first embodiment of the present invention will be described with reference to the drawings.

(1) Overall Configuration

Figure 1:
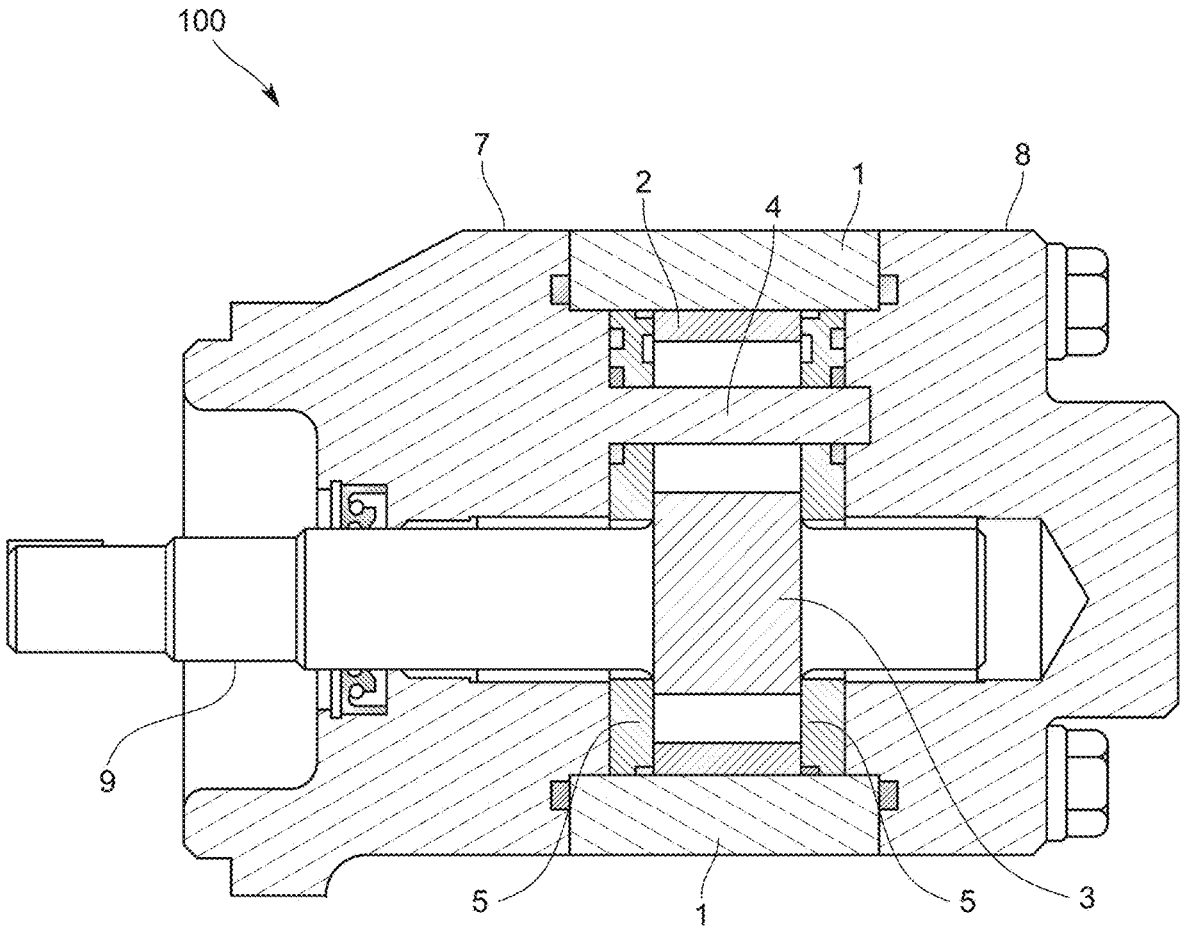
FIG. 1 is a longitudinal sectional view illustrating a configuration of an internal gear pump according to a first embodiment of the present invention.
Figure 2:
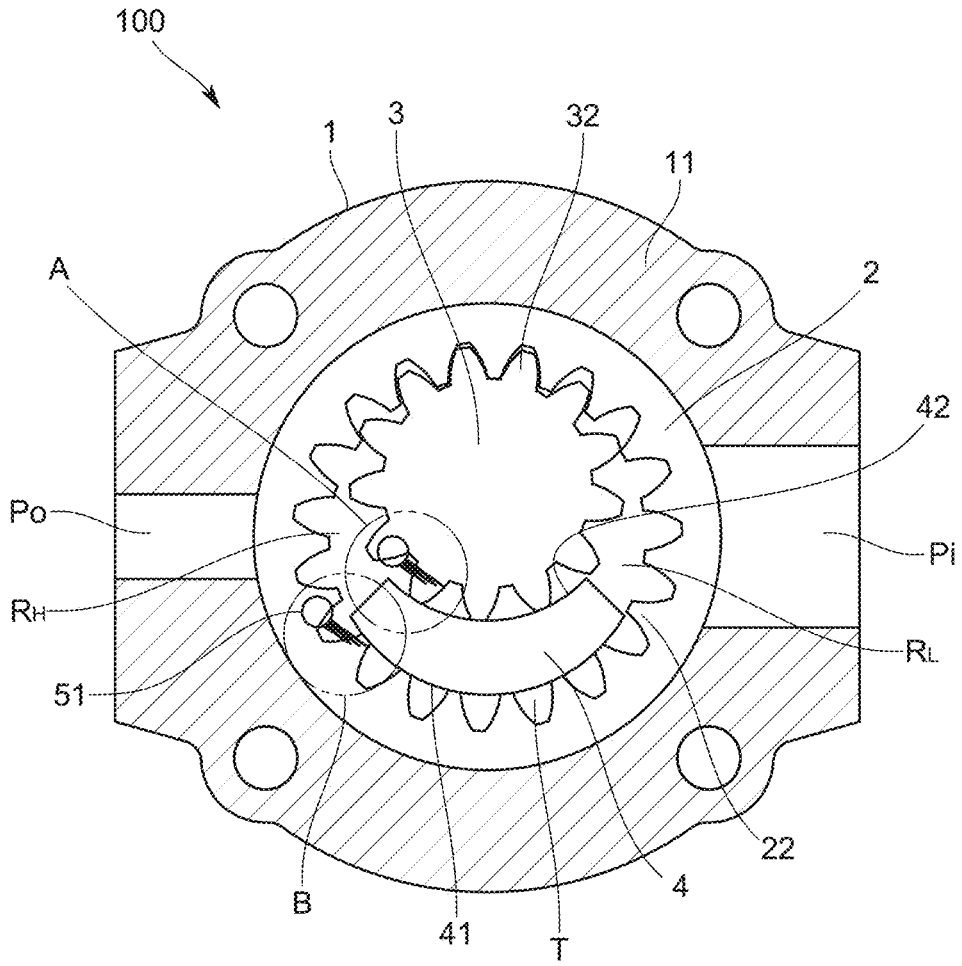
FIG. 2 is a transverse cross-sectional view illustrating a configuration of the internal gear pump according to the embodiment.

An internal gear pump 100 according to the present embodiment is used as a hydraulic source of, for example, an industrial vehicle, a construction machine, an agricultural machine, or the like, and is configured to suck and discharge a fluid (oil such as mineral oil. Also, referred to as operating fluid) by rotating a set of internal gear 2 and external gear 3 housed in a body 1. Specifically, as illustrated in FIGS. 1 and 2, the internal gear pump 100 includes the body 1, the internal gear 2, the external gear 3, a filler piece 4, and a sealing member 5.

The body 1 has a substantially cylindrical shape having a hollow body shape. As illustrated in FIG. 1, an opening on one end side of the body 1 in an axial direction is closed by a front cover 7, and an opening on the other end side is closed by a rear cover 8. As illustrated in FIG. 2, a side wall 11 of the body 1 is formed with a through hole communicating with an inlet $P_i$ for sucking oil and an outlet $P_o$ for discharging oil.

The internal gear 2 has a ring shape including a plurality of inward teeth 22 along a radial direction, and is a so-called internal gear. The internal gear 2 is rotatably fitted and accommodated in the body 1 such that its rotation axis is parallel to the axial direction of the body 1.

The external gear 3 includes a plurality of outward teeth 32 along the radial direction, and is a so-called pinion gear. The external gear 3 has a reference circle diameter smaller than a reference circle diameter of the internal gear 2 and the number of teeth smaller than the number of teeth of the internal gear 2. The external gear 3 is provided to be inscribed and meshed with the internal gear 2 such that its rotation axis is parallel to the rotation axis of the internal gear 2. As illustrated in FIG. 2, a liquid feeding space is formed between the external gear 3 and the internal gear 2. A drive shaft 9 for rotationally driving the external gear 3 is connected to the rotation shaft of the external gear 3.

The filler piece 4 is provided between the internal gear 2 and the external gear 3 in the body 1, and partitions the liquid feeding space into a high pressure region $R_H$ and a low pressure region $R_L$. Specifically, the filler piece 4 has a crescent shape integrally projected on the front cover 7, and includes an outer peripheral surface 41 in contact with tooth tips of the internal gear 2 and an inner peripheral surface 42 in contact with tooth tips of the external gear 3. The outer peripheral surface 41 has the same circle diameter as a tooth tip circle diameter of the internal gear 2, and simultaneously contacts a plurality of tooth tips of the internal gear 2 to seal oil accumulated in tooth grooves 21. The inner peripheral surface 42 has the same circle diameter as a tooth tip circle diameter of the external gear 3, and simultaneously contacts a plurality of tooth tips of the external gear 3 to seal oil accumulated in tooth grooves 31. As illustrated in FIG. 2, a plurality of enclosed spaces T (also referred to as outer enclosed spaces $T_o$) surrounded by the outer peripheral surface 41 of the filler piece 4 and the tooth grooves 21 of the internal gear 2 are formed between the filler piece 4 and the internal gear 2. A plurality of enclosed spaces T (also referred to as inner enclosed spaces $T_i$) surrounded by the inner peripheral surface 42 of the filler piece 4 and the tooth grooves 31 of the external gear 3 are formed between the filler piece 4 and the external gear 3. The high pressure region $R_H$ and the low pressure region $R_L$ communicate with the inlet $P_i$ and the outlet $P_o$, respectively, through ports (not shown).

The sealing member 5 of the present embodiment is inserted between the body 1 and both the gears 2 and 3 so as to cover both end surfaces of the internal gear 2 and the external gear 3, and seals the liquid feeding space. Specifically, the sealing member 5 (also referred to as a side plate) is a plate-like member having a constant thickness, and is fitted to an inner periphery of the body 1 so as to be slidable in the axial direction.

The sealing member 5 is provided with a communication port 51 that allows the high pressure region $R_H$ to communicate with a space between the sealing member 5 and the front cover 7 (or the rear cover 8). The communication port 51 is formed by a through hole penetrating the sealing member 5 in a plate thickness direction, and is opened on both side surfaces of the sealing member 5. The sealing member 5 is provided with a plurality of (specifically, two) the communication ports 51, and each of the communication ports 51 is provided at a position where the teeth 22 of the rotating internal gear 2 and the teeth 32 of the external gear 3 pass thereover in the high pressure region $R_H$ when viewed from the rotation axis direction.

In the sealing member 5, communication grooves 6 for communicating the high pressure region $R_H$ and the enclosed space T are formed. The communication grooves 6 are intended to gradually increase a pressure in the enclosed space T by introducing oil from the high pressure region $R_H$ into the enclosed space T having a relatively low pressure.

In the internal gear pump 100 configured as described above, the external gear 3 and the internal gear 2 are rotationally driven by the drive shaft 9 to enable the oil sucked from the inlet $P_i$ to be discharged from the outlet $P_o$. Specifically, when the external gear 3 and the internal gear 2 meshing with the external gear 3 are rotated, oil as a hydraulic fluid is introduced from the inlet $P_i$ to the low pressure region $R_L$, and the oil is enclosed in the enclosed space T, carried to the high pressure region $R_H$, and discharged from the outlet $P_o$.

Thus, in the internal gear pump 100 of the present embodiment, the communication grooves 6 are formed such that the cross-sectional area communicating with the enclosed space T continuously increases as the rotation phase of both the gears 2 and 3 advances, and its increase rate acceleratively increases. Specifically, in the internal gear pump 100 of the present embodiment, a plurality of communication grooves 6 for communicating the enclosed space T and the high pressure region $R_H$ are formed, and the respective communication grooves 6 are formed so that the high pressure region $R_H$ and the enclosed space T communicate with each other at different timings as the internal gear 2 and the external gear 3 rotate.

Figure 3:
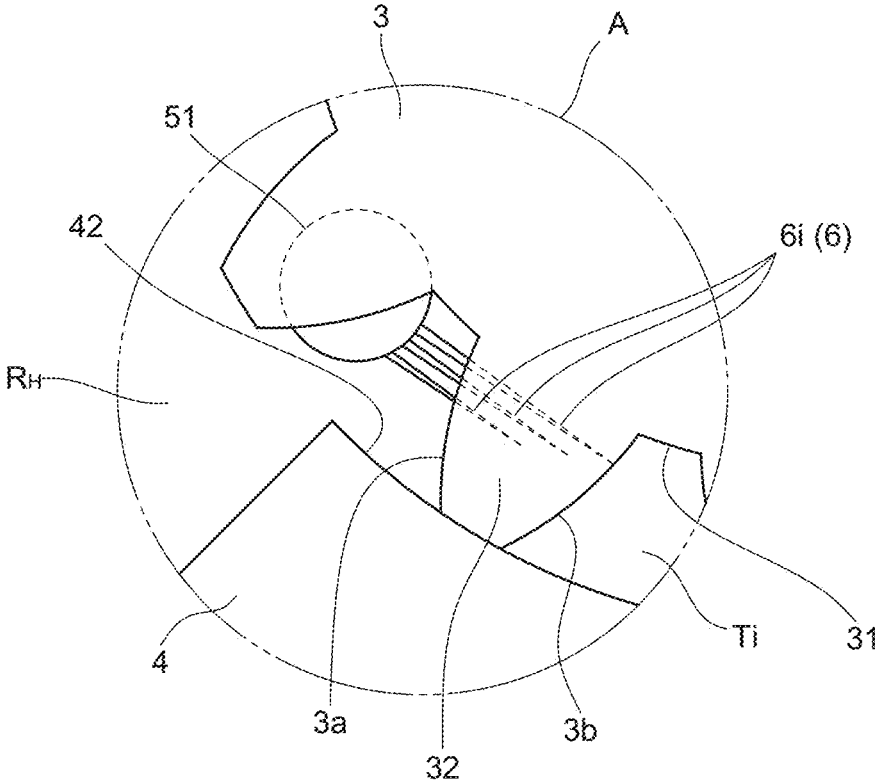
FIG. 3 is an enlarged view of a portion A in FIG. 2.
Figure 4:
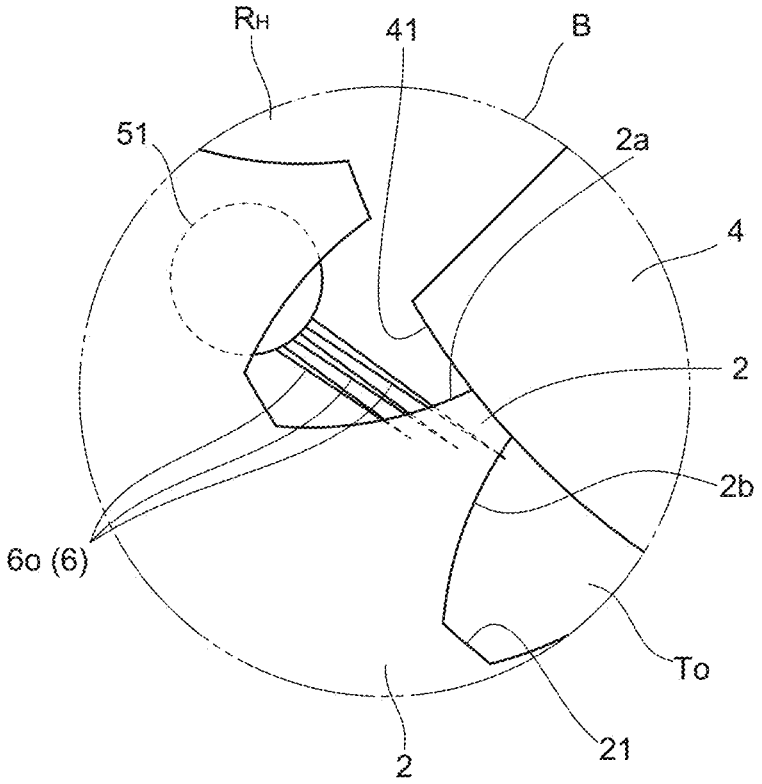
FIG. 4 is an enlarged view of a part B in FIG. 2.

More specifically, as shown in FIGS. 3 and 4, in the sealing member 5, a plurality of inner communication grooves $\mathbf{6}_i$ for allowing the high pressure region $R_H$ to communicate with the inner enclosed space Ti and a plurality of outer communication grooves $\mathbf{6}_o$ for allowing the high pressure region $R_H$ to communicate with the outer enclosed space $T_o$ are formed as the communication grooves 6. The inner communication grooves $\mathbf{6}_i$ have different timings at which the high pressure region $R_H$ communicates with the inner enclosed space $T_i$ as the gears 2 and 3 rotate, and the outer communication grooves $\mathbf{6}_i$ have different timings at which the high pressure region $R_H$ communicates with the outer enclosed space $T_o$ as the gears 2 and 3 rotate.

The plurality of inner communication grooves $\mathbf{6}_i$ and the plurality of outer communication grooves $\mathbf{6}_o$ are formed in the same number (three in this case) in the sealing member 5. The communication grooves $\mathbf{6}_i$ and $\mathbf{6}_o$ are formed such that the timing at which the inner enclosed space $T_i$ comes on each of the inner communication grooves $\mathbf{6}_i$ matches with the timing at which the outer enclosed space $T_o$ comes on each of the outer communication grooves $\mathbf{6}_o$ as the gears 2 and 3 rotate.

Specifically, each of the communication grooves 6 has a needle shape formed along the side surface of the sealing member 5. More specifically, each communication groove 6 is formed such that a base end thereof is connected to the communication port 51 in the high pressure region $R_H$ and a tip thereof is directed straight toward the enclosed space T. Here, each of the communication grooves 6 has a tapered shape toward the tip.

The communication grooves 6 communicating with the common enclosed space T are arranged at substantially equal intervals away from a central axis of the body 1. Further, the communication grooves 6 are formed so as to be substantially parallel to each other from the communication port 51 toward the enclosed space T. A depth, width, and length of each of the communication grooves 6 may be different from each other or may be the same. Here, the length of each communication groove 6 is set to be shorter as it is farther from the central axis of the body 1.

The plurality of communication grooves 6 are formed so as to cross the teeth 22 and 32 that partition the high pressure region $R_H$ and the enclosed space T, and allow the high pressure region $R_H$ and the enclosed space T adjacent thereto to communicate with each other. Specifically, each inner communication groove $\mathbf{6}_i$ is formed so as to cross the teeth 32 of the external gear 3 that partitions the high pressure region $R_H$ and the inner enclosed space $T_i$. Each of the outer communication grooves $\mathbf{6}_o$ is formed so as to cross the teeth 22 of the internal gear 2 that partitions the high pressure region $R_H$ and the outer enclosed space $T_o$.

The positions of the tips of these communication grooves 6 are set such that a timing at which the tooth grooves 21 and 31 come on the respective communication grooves 6 is different from each other as the gears 2 and 3 rotate. Specifically, the plurality of communication grooves 6 communicating with the common enclosed space T are formed such that the tooth surfaces 2*b* and 3*b* on a front side in a rotational direction configuring the tooth grooves 21 and 31 of the gears 2 and 3 have different rotation phases reaching the tips of the respective communication grooves 6. For example, as illustrated in FIG. 3, the plurality of inner communication grooves $\mathbf{6}_i$ are formed such that the tooth surfaces (that is, tooth surfaces of the teeth 32 on the rear side in the rotational direction) 3*b* on the front side in the rotational direction configuring the tooth grooves 31 of the external gear 3 have different rotation phases reaching the tips of the respective inner communication grooves 6*j*. As illustrated in FIG. 4, the plurality of outer communication grooves $\mathbf{6}_o$ are formed such that the tooth surfaces (that is, tooth surfaces of the teeth 22 on the rear side in the rotational direction) 2*b* on the front side in the rotational direction configuring the tooth grooves 21 of the internal gear 2 have different rotation phases reaching the tips of the respective outer communication grooves 60.

Figure 5:
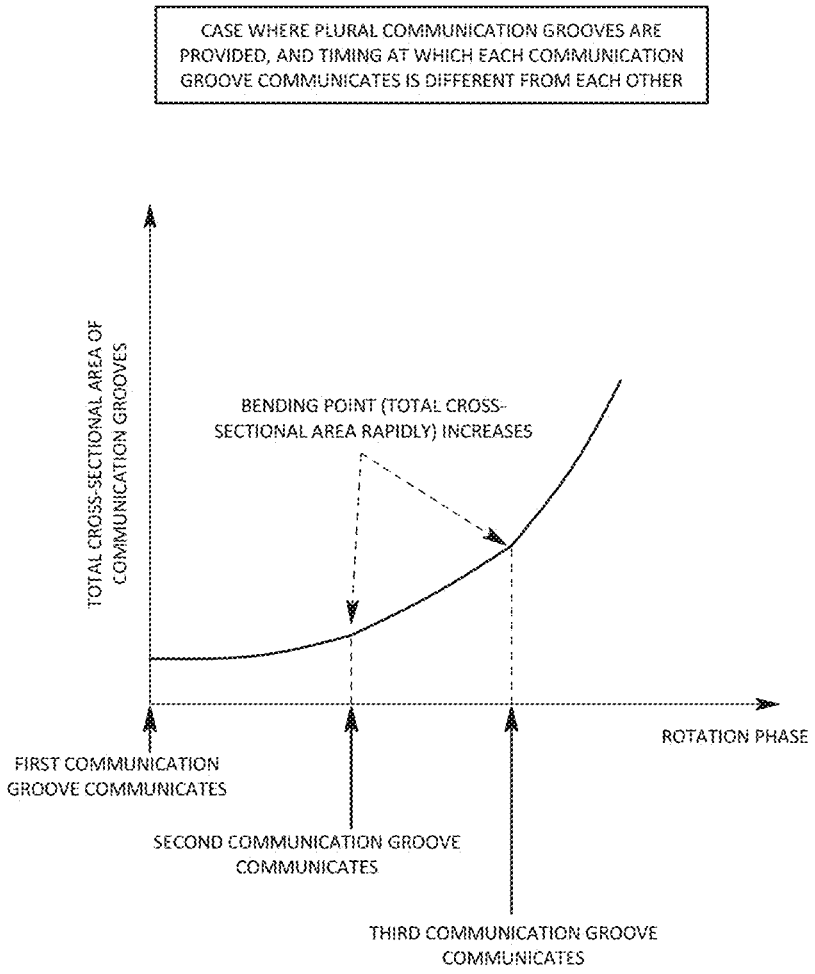
FIG. 5 is a diagram illustrating a relationship between a rotation phase of the internal gear pump and a total cross-sectional area of communication grooves according to the embodiment.

With the formation of each communication groove 6 as described above, as illustrated in FIG. 5, in a relationship between the rotation phases of the gears 2 and 3 and a total cross-sectional area of each communication groove 6 communicating with the enclosed space T, there can exist bending points at which the total cross-sectional area is continuously increased as the rotation phase advances and an increase rate in the total cross-sectional area with the progress of the rotation phase changes stepwise (or discontinuously). That is, with the rotation of the gears 2 and 3, the total cross-sectional area of the communication grooves 6 communicating with the enclosed space Tis accelerated every time the tooth grooves 21 and 31 come on the tips of the communication grooves 6.

The "cross-sectional area of the communication grooves 6 communicating with the enclosed space T" means flow passage cross-sectional areas of the communication grooves 6 at the positions of the tooth surfaces 2*a* and 3*a* of the teeth 22 and 32 on the front side in the rotational direction in a state where the communication grooves 6 communicates with the enclosed space T, that is, in a state where the communication grooves 6 cross the teeth 22 and 32 partitioning the high pressure region $R_H$ and the enclosed space T.

(2) Effects

Figure 6:
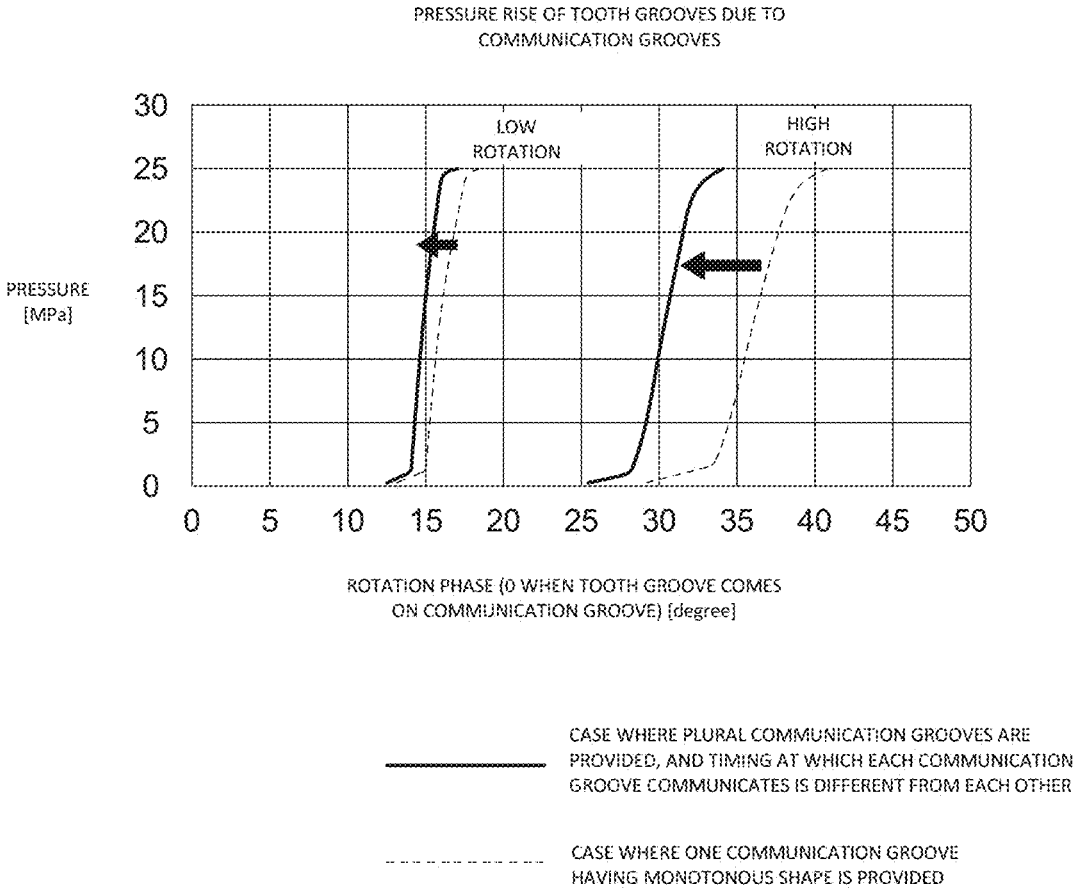
FIG. 6 is a diagram illustrating a relationship between a rotation phase of the internal gear pump and a pressure in a tooth groove according to the embodiment.

According to the internal gear pump 100 of the present embodiment configured as described above, since the plurality of communication grooves 6 are formed so that the high pressure region $R_H$ and the enclosed space T communicate with each other at different timings as the gears 2 and 3 rotate, and the total cross-sectional area of the communication grooves 6 communicating with the enclosed space T increases each time the tooth grooves 21 and 31 of the gears 2 and 3 come on the communication grooves 6 while the rotation phase advances. As a result, as the rotation phase of both the gears 2 and 3 advances, the total cross-sectional area of the plurality of communication grooves 6 communicating with the enclosed space T continuously increases, and the increase rate acceleratively increases. Therefore, the amount of hydraulic fluid (oil or the like) introduced from each of the communication grooves 6 into the tooth grooves 21 and 31 of the gears 2 and 3 can be acceleratively increased with rotation. Therefore, as compared with the conventional one having one monotonically shaped communication groove (for example, a linear communication groove in which the cross-sectional area does not change as the rotation phase of the gear advances, a communication groove in which the cross-sectional area monotonously increases as the rotation phase of the gear advances, or the like), only timing of a pressure rise in the tooth grooves 21 and 31 at the time of high rotation can be significantly advanced without significantly advancing the timing of the pressure rise in the tooth grooves 21 and 31 at the time of low rotation of both the gears 2 and 3. As a result, as illustrated in FIG. 6, as compared with the case where there is one monotonic communication groove that communicates the enclosed space T and the high pressure region $R_H$, in the internal gear pump 100 and the internal gear motor 100, the difference in the timing of the pressure rise of the tooth grooves 21 and 31 between the low rotation and the high rotation can be reduced, and the performance and durability of the pump can be improved.

Figure 7:
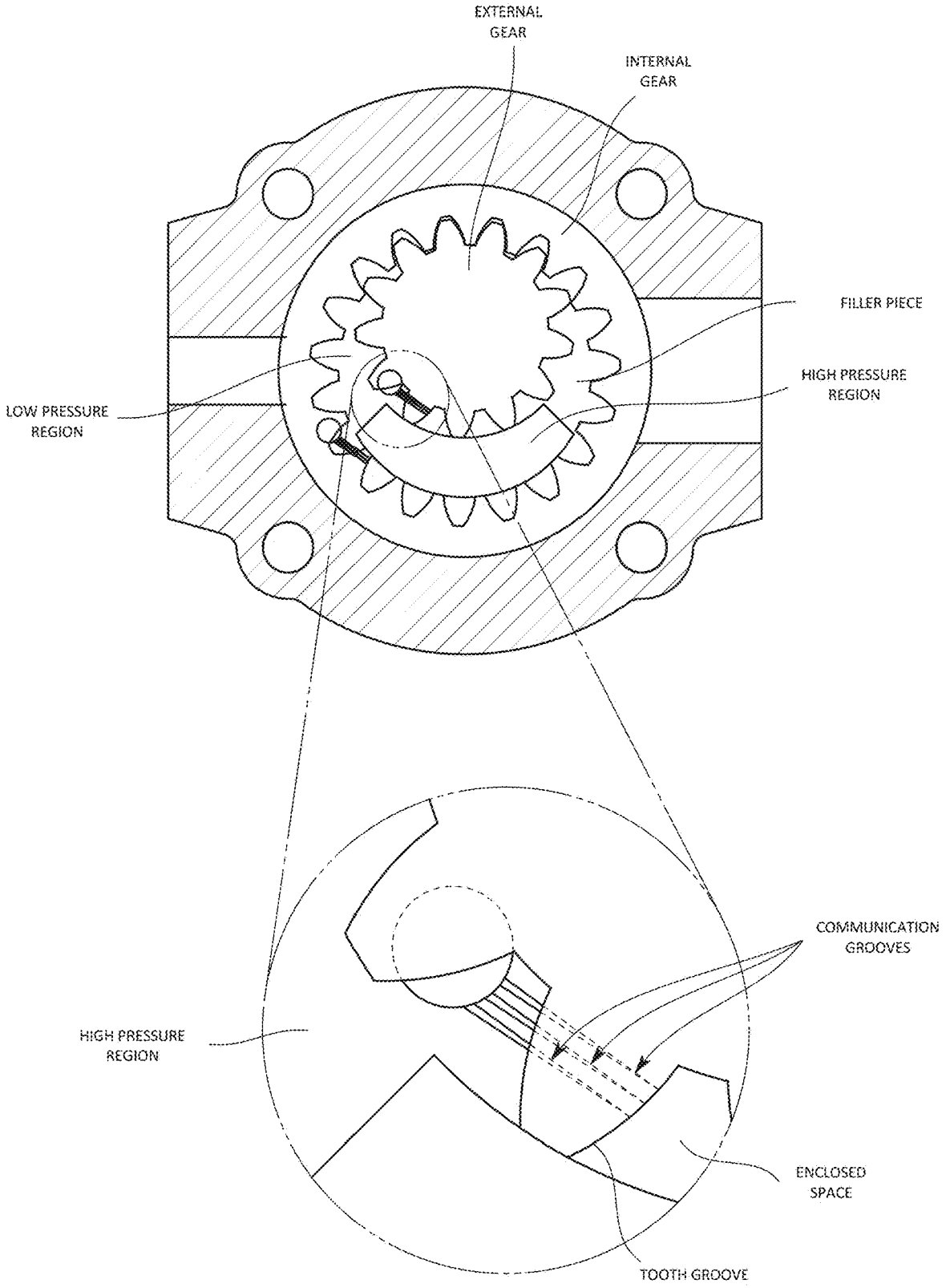
FIG. 7 is an enlarged view illustrating a configuration around communication grooves in a case where a plurality of communication grooves are provided and timings at which respective communication grooves communicate match each other.
Figure 8:
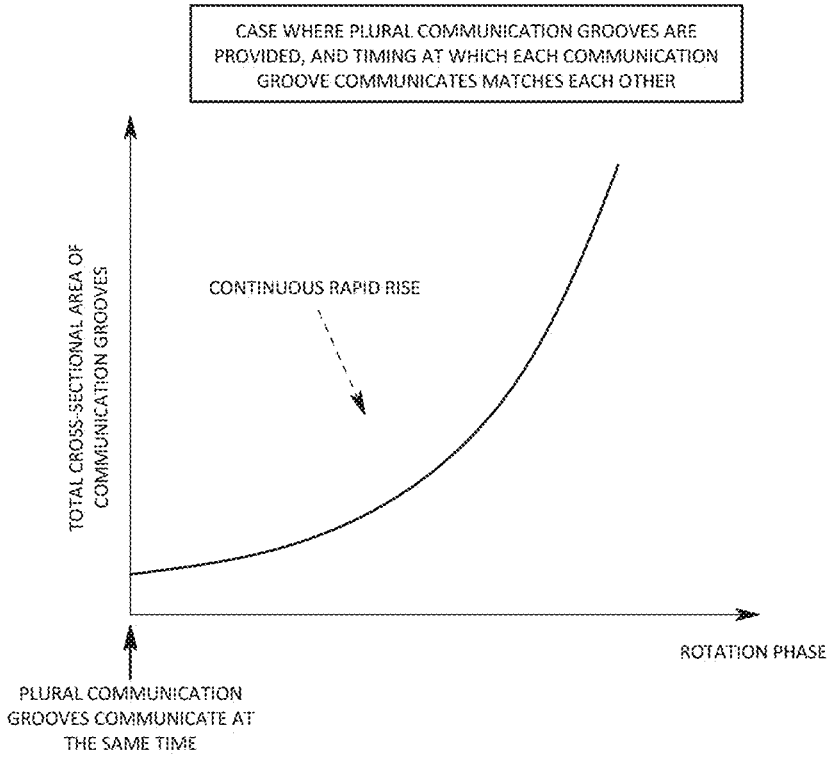
FIG. 8 is a diagram illustrating a relationship between the rotation phase of the internal gear pump and the total cross-sectional area of the communication grooves in a case where a plurality of communication grooves are provided and the communication timings of the respective communication grooves match each other.
Figure 9:
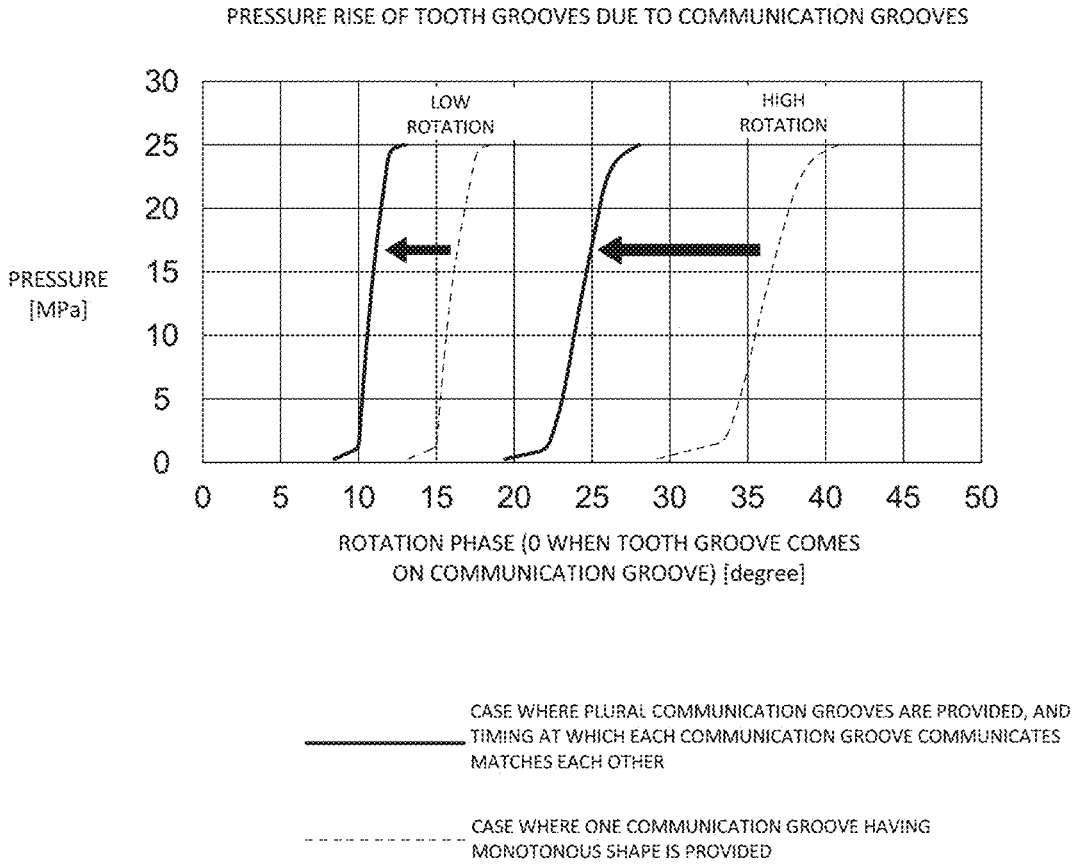
FIG. 9 is a diagram illustrating a relationship between the rotation phase of the internal gear pump and the pressure in the tooth groove in a case where a plurality of communication grooves are provided and the communication timings of the respective communication grooves match each other.

Here, even in a case where there are a plurality of communication grooves for communicating the enclosed space T and the high pressure region $R_H$, for example, as illustrated in FIG. 7, in a case where the respective communication grooves are formed so that the high pressure region $R_H$ and the enclosed space T communicate with each other at the same timing as the gear rotates, the effect of the present embodiment is not sufficiently exhibited. That is, in this case, as illustrated in FIG. 8, when the tooth grooves of the gear come on the respective communication grooves, the total cross-sectional area of the respective communication grooves communicating with the enclosed space T continuously increases rapidly as the gears rotate. Then, as illustrated in FIG. 9, as compared with the case where there is one monotonically shaped communication groove, not only the timing of the pressure rise of the tooth grooves at the time of high rotation but also the timing of the pressure rise of the tooth grooves at the time of low rotation are significantly advanced. As a result, the difference in the timing of the pressure rise in the tooth grooves between the time of low rotation and the time of high rotation can be sufficiently reduced, and the performance and durability of the pump cannot be sufficiently improved.

[2] Second Embodiment

Figure 10:
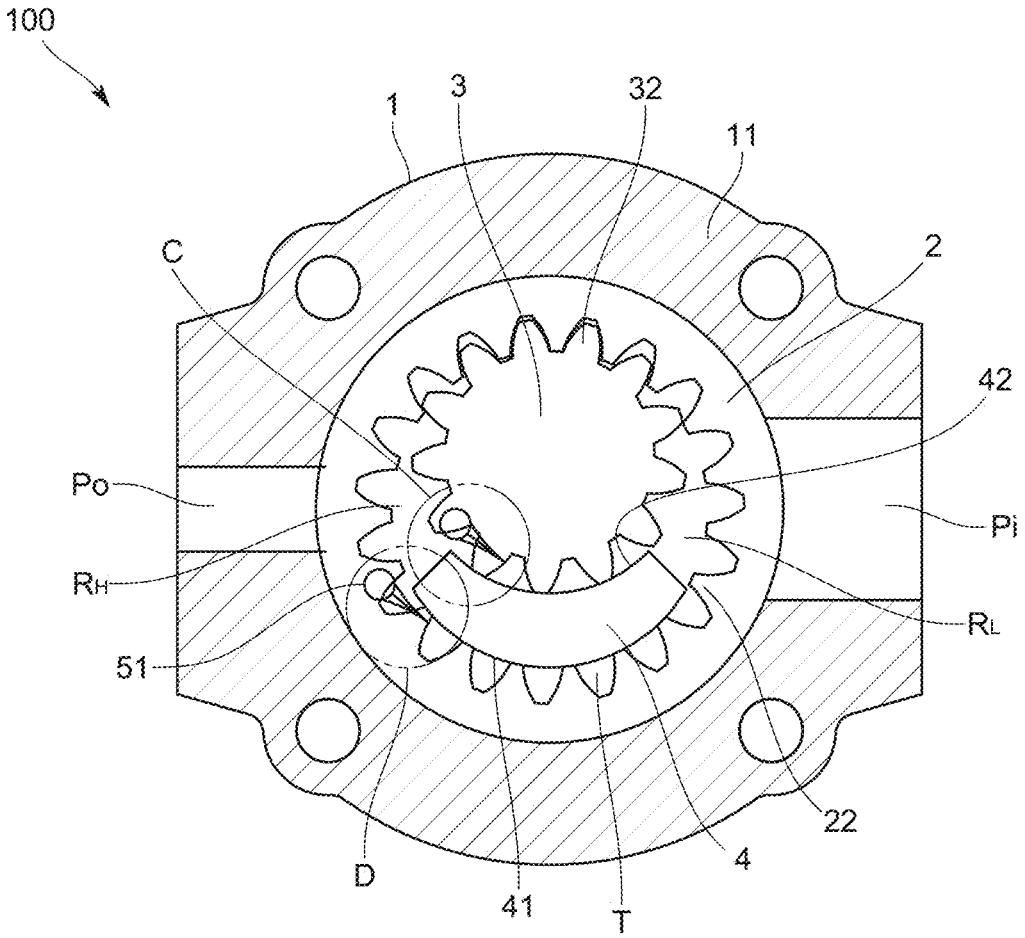
FIG. 10 is a transverse cross-sectional view illustrating a configuration of an internal gear pump according to a second embodiment of the present invention.

Next, an internal gear pump 100 according to a second embodiment of the present invention will be described with reference to the drawings. As illustrated in FIG. 10, a configuration of the internal gear pump 100 of the second embodiment other than the communication grooves 6 is substantially the same as that of the first embodiment. Hereinafter, the configuration of communication grooves 6 of the internal gear pump 100 according to the second embodiment will be mainly described.

In the internal gear pump 100 of the second embodiment, as in the first embodiment, the communication grooves 6 are formed such that a cross-sectional area communicating with an enclosed space T continuously increases as a rotation phase of both gears 2 and 3 advances, and its increase rate acceleratively increases.

Figure 11:
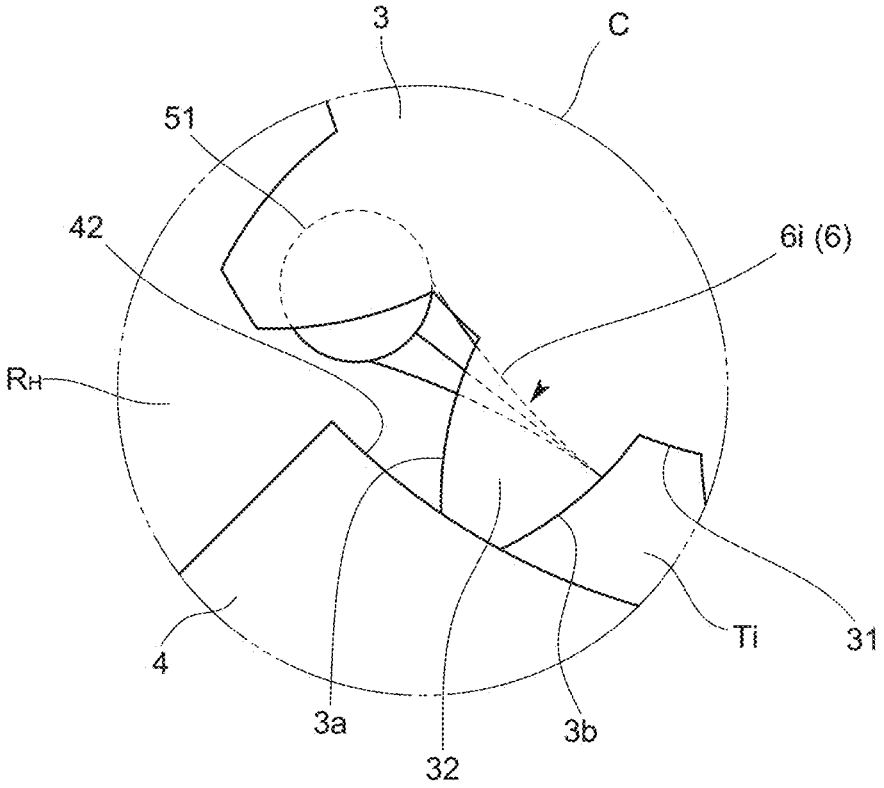
FIG. 11 is an enlarged view of a portion C in FIG. 10.
Figure 12:
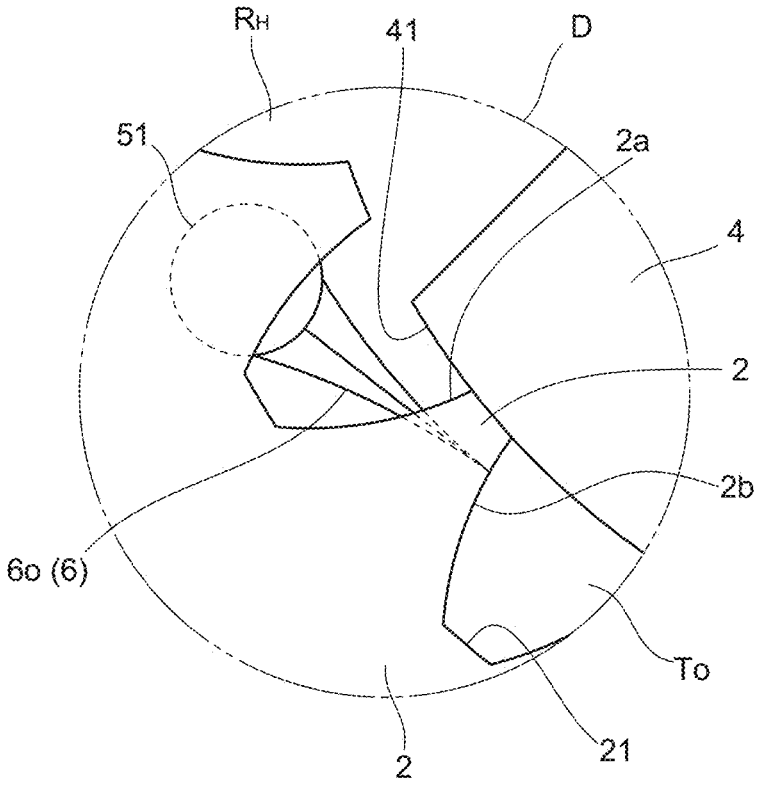
FIG. 12 is an enlarged view of a portion D in FIG. 10.

Specifically, as shown in FIGS. 11 and 12, in the sealing member 5, inner communication grooves $\mathbf{6}_i$ for allowing a high pressure region $R_H$ to communicate with an inner enclosed space $T_i$ and outer communication grooves $\mathbf{6}_o$ for allowing the high pressure region $R_H$ to communicate with an outer enclosed space $T_o$ are formed as the communication grooves 6. One inner communication groove $\mathbf{6}_i$ and one outer communication groove $\mathbf{6}_o$ are formed in the sealing member 5. The communication grooves $\mathbf{6}_i$ and $\mathbf{6}_o$ are formed such that the timing at which the inner enclosed space $T_i$ comes on the inner communication grooves $\mathbf{6}_i$ matches with the timing at which the outer enclosed space $T_o$ comes on the outer communication grooves $\mathbf{6}_o$ as the rotation phases of both the gears 2 and 3 advance.

Specifically, the communication grooves 6 have a needle shape formed along the side surface of the sealing member 5. More specifically, the communication groove 6 is formed such that a base end thereof is connected to the communication port 51 in the high pressure region $R_H$ and a tip thereof is tapered toward the enclosed space T.

Figure 13:
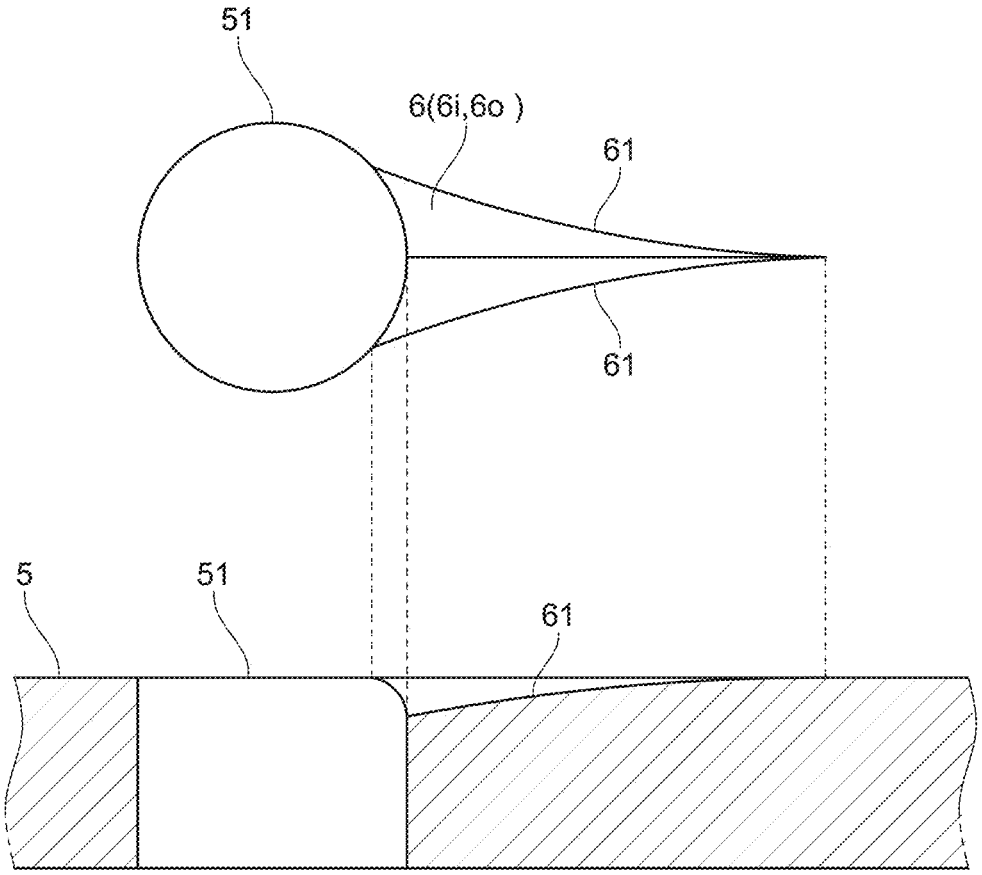
FIG. 13 is a view illustrating in detail configurations of the inner communication groove and the outer communication groove in the embodiment.

In the internal gear pump 100 of the second embodiment, as illustrated in FIG. 13, the communication grooves 6 have a conical shape (specifically, a pyramidal shape) tapered from the high pressure region $R_H$ toward the enclosed space T, and at least one of plural sides 61 thereof has a curved shape (R shape) gradually widening outward (widening) toward an end from a tip side (enclosed space T side) toward a base end side (high pressure region $R_H$ side). In this embodiment, the communication groove 6 has a triangular pyramid shape having three sides 61, and all of the three sides 61 have a curved shape widening outward from the tip side toward the base end side. Here, each side 61 is formed so as to widen outward in a quadratic function manner from the tip side toward the base end side. The shape of the communication groove 6 is not limited to the triangular pyramid shape, and may be, for example, a polygonal pyramid shape such as a quadrangular pyramid shape or a conical shape.

(2) Effects

Figure 14:
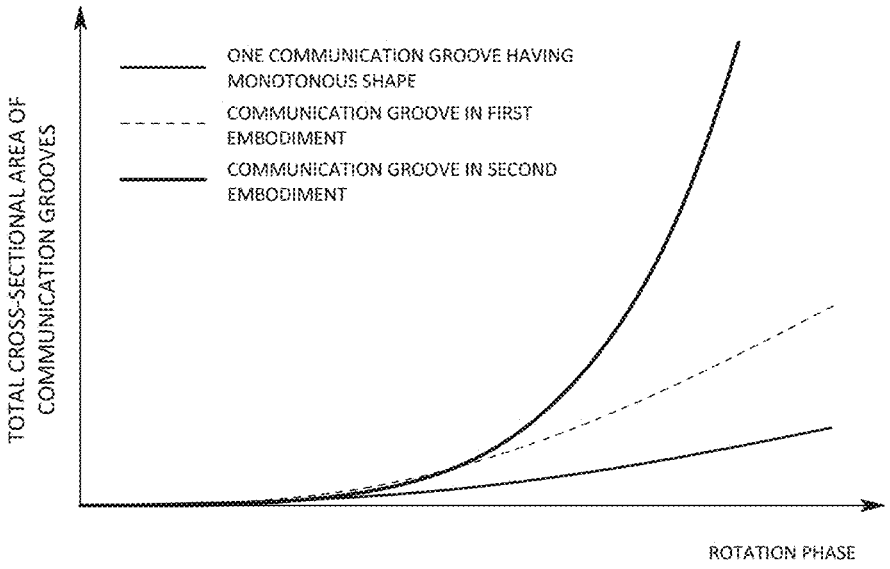
FIG. 14 is a diagram illustrating a relationship between a rotation phase of the internal gear pump and a total cross-sectional area of communication grooves according to the embodiment.
Figure 15:
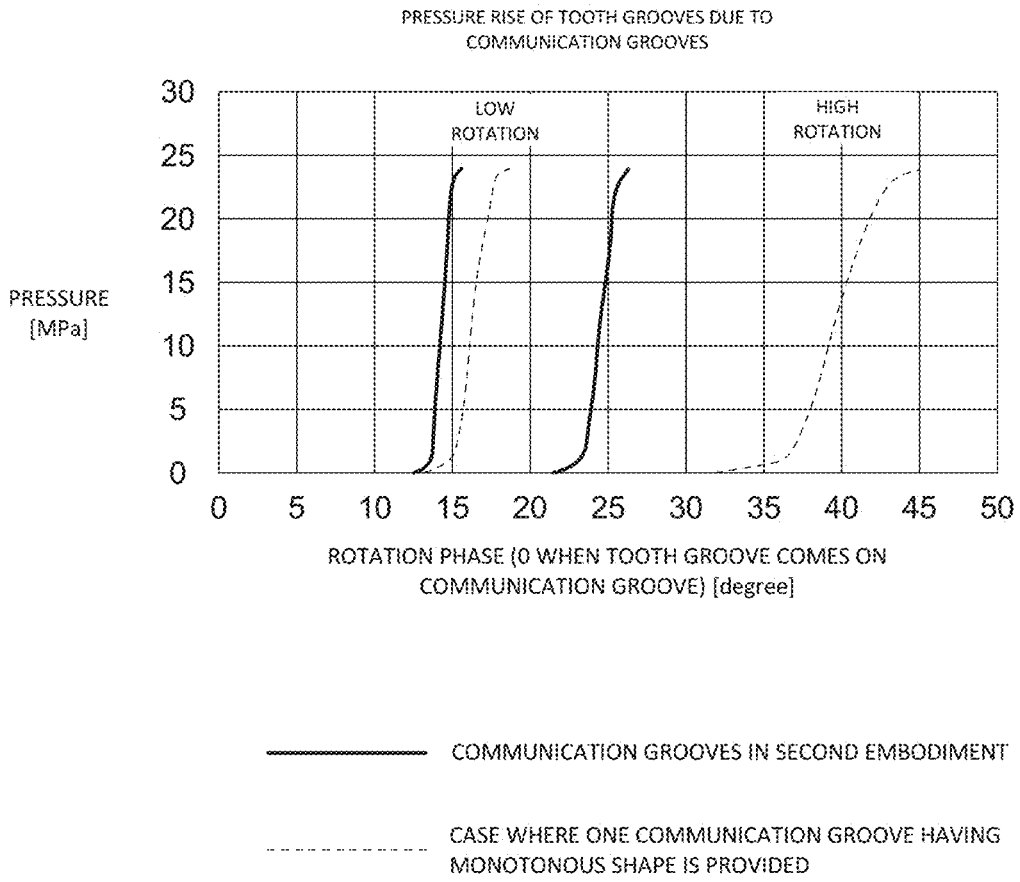
FIG. 15 is a diagram illustrating a relationship between a rotation phase of the internal gear pump and a pressure in a tooth groove according to the embodiment.

According to the internal gear pump 100 of the second embodiment configured as described above, the communication grooves 6 has a triangular pyramid shape that tapers from the high pressure region $R_H$ toward the enclosed space T, and all of the plurality of sides 61 have a curved shape that widens outward from the tip side toward the base end side. Therefore, as illustrated in FIG. 14, as the rotation phase of both the gears 2 and 3 advances, the cross-sectional area of the communication grooves 6 communicating with the enclosed space T can be continuously increased, and an increase rate thereof can be acceleratively increased. As illustrated in FIG. 14, according to the configuration of the communication grooves 6 of the present embodiment, the change rate (increase rate) of the cross-sectional area of the communication grooves 6 accompanying the progress of the rotation phase of both the gears 2 and 3 can be rapidly increased as compared with the conventional communication groove in which only one communication groove having a monotonous shape is formed or the communication grooves 6 of the first embodiment. As a result, in the internal gear pump 100 of the second embodiment, the amount of hydraulic fluid (oil or the like) introduced from the communication grooves 6 into the tooth grooves 21 and 31 of both the gears 2 and 3 can be acceleratively increased with the rotation of the gears 2 and 3. As a result, as illustrated in FIG. 15, only the timing of the pressure rise in the tooth grooves 21 and 31 at the time of high rotation can be significantly advanced without significantly advancing the timing of the pressure rise in the tooth grooves 21 and 31 at the time of low rotation of both the gears 2 and 3, as compared with the conventional one in which there is one communication groove having a monotonous shape. As a result, the internal gear pump 100 of the present embodiment can reduce the difference in the timing of the pressure rise of the tooth grooves 21 and 31 between the time of low rotation and the time of high rotation, and can improve the performance and durability of the pump.

In addition, in the internal gear pump 100 of the second embodiment, the communication grooves 6 have a pyramidal shape that widens from the tip side toward the base end side, so that the increase rate in the flow path cross-sectional area of the communication grooves 6 accompanying the rotation of the gears 2 and 3 can be acceleratively increased without forming a plurality of communication grooves. Therefore, even in a case where it is difficult to form the plurality of communication grooves 6 in a limited machining area, one communication groove 6 is formed, so that an effect of significantly advancing only the timing of the pressure increase in the tooth grooves 21 and 31 at the time of high rotation can be achieved without significantly advancing the timing of the pressure increase in the tooth grooves 21 and 31 at the time of low rotation of the gears 2 and 3.

[3] Other Embodiments

Note that the internal gear pump 100 of the present invention is not limited to the above embodiments.

Figure 16:
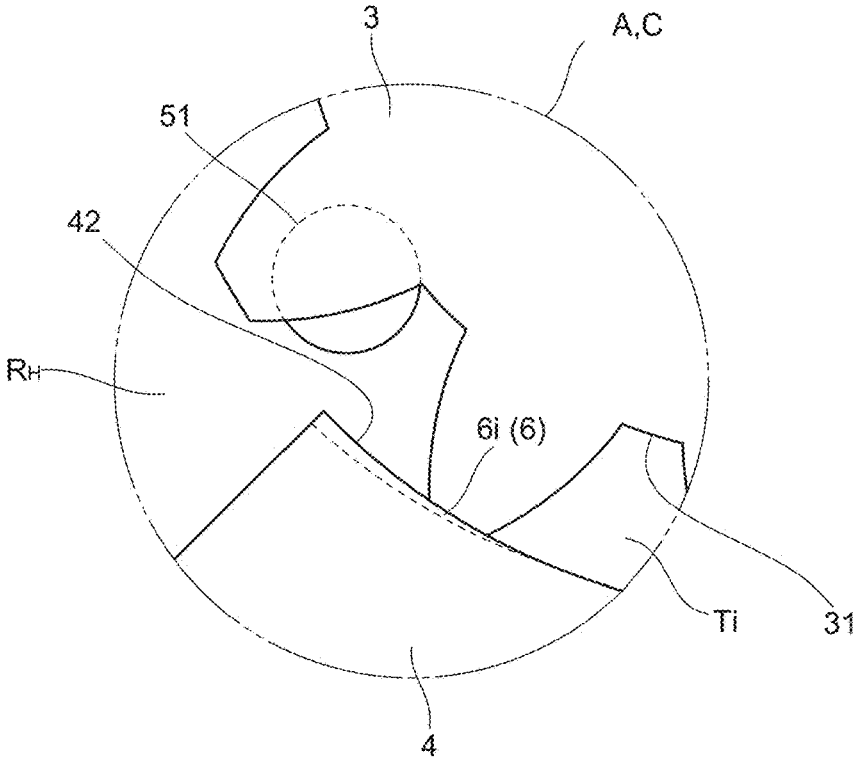
FIG. 16 is a view illustrating a configuration of a communication groove of an internal gear pump of another embodiment.
Figure 16:
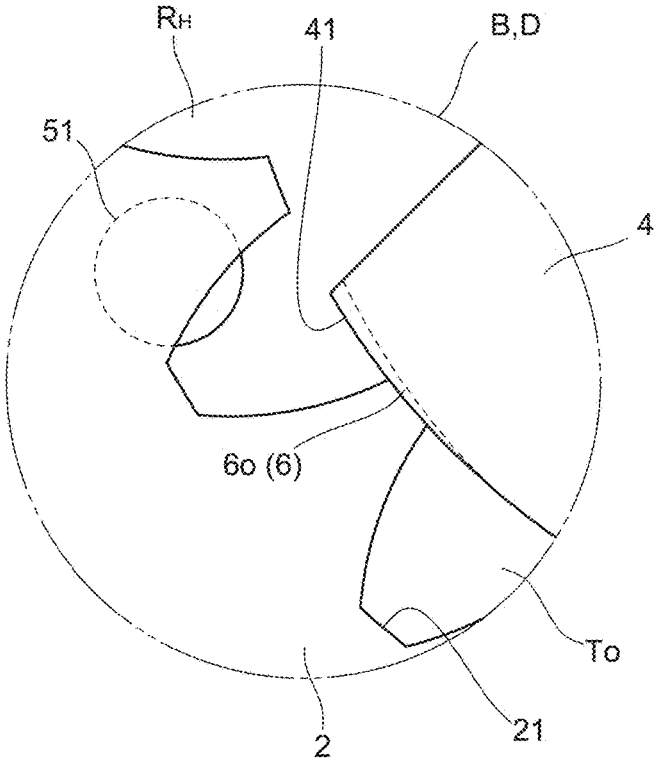

For example, in the internal gear pump 100 of each of the above embodiments, the one or more communication grooves 6 are formed in the sealing member 5, but the present invention is not limited thereto. In another embodiment, one or more communication grooves 6 may be formed in a peripheral surface of a filler piece 4 which comes into contact with cutting edges of the gears 2 and 3 to seal the tooth grooves 21 and 31. For example, as shown in FIG. 16, one or more outer communication grooves $\mathbf{6}_o$ may be formed in an outer peripheral surface 41 of the filler piece 4 so as to extend from a high pressure region $R_H$ toward an outer enclosed space $T_o$, and one or more inner communication grooves $\mathbf{6}_i$ may be formed in an inner peripheral surface 42 of the filler piece 4 so as to extend from the high pressure region $R_H$ toward the inner enclosed space $T_i$.

In addition, the sealing member 5 of each of the above embodiments is configured by the side plate inserted between the body 1 and both the gears 2 and 3, but is not limited thereto. The internal gear pump 100 of another embodiment may not include the side plate, and the function as the sealing member 5 may be exerted by the front cover 7 and the rear cover 8. In this case, one or more communication grooves 6 may be formed on the side surface of the front cover 7 or the rear cover 8 facing the liquid feeding space.

In another embodiment, the base end of the communication grooves 6 may not be connected to the communication port 51 as long as the high pressure region $R_H$ and the enclosed space T can communicate with each other. The communication port 51 may not be provided at a position through which the teeth 22 and 32 of the rotating gears 2 and 3 pass.

In the first embodiment, the plurality of communication grooves 6 communicating with the common enclosed space T are formed so as to be substantially parallel to each other, but the present invention is not limited thereto. In addition, each of the communication grooves 6 of the first embodiment may have, for example, a rectangular shape instead of a tapered shape. Each of the communication grooves 6 may be linear or curved.

In the first embodiment, the plurality of outer communication grooves $\mathbf{6}_o$ and the same number of inner communication grooves $\mathbf{6}_i$ are formed, but the present invention is not limited thereto. In another embodiment, only one communication grooves 6 of the outer communication grooves $\mathbf{6}_o$ and the inner communication grooves $\mathbf{6}_i$ may be formed in plurality, and the other communication grooves may be one or zero. One of the plurality of outer communication grooves $\mathbf{6}_o$ and the plurality of inner communication grooves $\mathbf{6}_i$ may be formed so that the high pressure region $R_H$ and the enclosed space T communicate with each other at different timings as the gears 2 and 3 rotate, and the other may be formed so that the high pressure region $R_H$ and the enclosed space T communicate with each other at the same timing as the gears 2 and 3 rotate. In addition, these communication grooves 6 may not be formed such that the timing at which the inner enclosed space $T_i$ comes on each of the inner communication grooves $\mathbf{6}_i$ matches with the timing at which the outer enclosed space $T_o$ comes on each of the outer communication grooves $\mathbf{6}_o$ as the gears 2 and 3 rotate. It is preferable that the communication grooves 6 are formed such that the timings at which the pressures in the tooth grooves 21 and 31 increase are substantially the same as each other at the time of high rotation and/or low rotation of both the gears 2 and 3.

The communication grooves 6 of the internal gear pump 100 according to another embodiment may be a combination of a part or all of the aspect of the communication grooves 6 in the first embodiment and a part or all of the aspect of the communication grooves 6 in the second embodiment. For example, in the internal gear pump 100 of another embodiment, a plurality of communication grooves 6 are formed so that the high pressure region $R_H$ and the enclosed space T communicate with each other at different timings with the rotation of both the gears 2 and 3. A part or all of the plurality of communication grooves 6 may have a pyramid shape tapered from the high pressure region $R_H$ toward the enclosed space T, and at least one side of the pyramid shape may have a curved shape widening outward from the tip side toward the base end side.

The internal gear pump 100 of each embodiment described above can also function as an internal gear motor 100 in other embodiments. For example, a hydraulic fluid is introduced into a liquid feeding space from an inlet $P_i$ and discharging the hydraulic fluid from the outlet $P_o$, to enable rotational torque to be applied to the drive shaft 9 connected to the rotation shaft of the external gear 3. When functioning as the internal gear motor 100, in the liquid feeding space, a region communicating with the inlet $P_i$ is the high pressure region $R_H$, and a region communicating with the outlet $P_o$ is the low pressure region $R_L$. That is, in the case of functioning as the internal gear motor 100, the communication grooves 6 are formed so as to communicate the enclosed space T with the low pressure region $R_L$, and the communication grooves 6 is formed so that a cross-sectional area of the communication grooves 6 communicating with the enclosed space T continuously increases as the rotation phase of both the gears 2 and 3 advances, and the increase rate thereof acceleratively increases. In this case, the communication grooves 6 may have a pyramid shape tapered from the high pressure region $R_H$ toward the enclosed space T, and at least one side 61 thereof may have a curved shape widening outward from the tip side toward the base end side. Further, the plurality of communication grooves 6 are formed so as to communicate the enclosed space T with the low pressure region $R_L$, and the respective communication grooves 6 are formed so that the low pressure region $R_L$ and the enclosed space T communicate with each other at different timings as the internal gear 2 and the external gear 3 rotate.

[4] Aspects of Internal Gear Pump 100 Included in the Present Specification

It is understood by those skilled in the art that the plurality of exemplary embodiments described above are specific examples of the following aspects.

(Section 1) An internal gear pump according to one aspect may include: an internal gear rotatably fitted in a body; an external gear inscribed in and meshed with the internal gear; a filler piece that partitions a liquid feeding space formed between the internal gear and the external gear into a high pressure region and a low pressure region; and a sealing member that covers both end surfaces of both the gears in a rotation axis direction and seals the liquid feeding space, in which a communication groove for communicating an enclosed space surrounded by the filler piece and a tooth groove of at least one of the gears with the high pressure region is formed, and the communication groove is formed such that a cross-sectional area communicating with the enclosed space continuously increases and an increase rate thereof acceleratively increases as a rotation phase of both the gears advances.

According to the internal gear pump according to a section 1, since the communication groove is formed such that the cross-sectional area communicating with the enclosed space continuously increases as the rotation phase of both the gears advances, and the increase rate acceleratively increases, the amount of a hydraulic fluid (oil or the like) introduced from the communication groove into the tooth groove of the gear can be acceleratively increased with the rotation. Therefore, only the timing of the pressure change in the tooth groove at the time of high rotation can be significantly advanced without significantly advancing the timing of the pressure change in the tooth groove at the time of low rotation of both the gears. As a result, in the internal gear pump, the difference of the timing of the pressure change in the tooth groove between the time of low rotation and the time of high rotation is reduce to enable an improvement in the performance and durability of the pump. The "cross-sectional area of the communication grooves" is a flow path cross-sectional area of one communication groove in a case where there is one communication groove communicating with the enclosed space, and is a total flow path cross-sectional areas of a plurality of communication grooves in a case where a plurality of communication grooves communicating with the common enclosed space are formed.

(Section 2) As a specific aspect of the internal gear pump according to the section 1, the communication groove has a pyramid shape tapered from the high pressure region toward the enclosed space, and at least one side of the pyramid shape has a curved shape widening outward from the tip side toward the base end side.

According to the internal gear pump according to a section 2, since the communication groove has a pyramidal shape in which sides spread in a curved shape from a tip toward a base end, a cross-sectional area of the communication groove communicating with the enclosed space can be continuously increased as the rotation phase of both the gears advances, and the increase rate thereof can be acceleratively increased.

In addition, according to the internal gear pump according to the section 2, the increase rate of the cross-sectional area of the communication grooves can be acceleratively increased with the rotation even in the case of one communication groove without forming the plurality of communication grooves. Therefore, even in a case where it is difficult to form the plurality of communication grooves in a limited processing region, the effect of the internal gear pump according to the section 1 can be achieved by one communication groove.

(Section 3) As a specific aspect of the internal gear pump according to the section 2, the communication groove has a triangular pyramid shape tapered from the high pressure region toward the enclosed space, and three sides of the shape have a curved shape widening outward from the tip side toward the base end side.

According to the internal gear pump according to a section 3, the effect of the internal gear pump according to the section 2 can be more remarkably exhibited.

(Section 4) In the internal gear pump according to any one of the sections 1 to 3, a plurality of the communication grooves may be formed, and the plurality of communication grooves may be formed so that the high pressure region and the enclosed space communicate with each other at different timings as both the gears rotate.

According to the internal gear pump according to a section 4, since the plurality of communication grooves are formed so that the high pressure region and the enclosed space communicate with each other at different timings as both the gears rotate, the total cross-sectional area of the respective communication grooves communicating with the enclosed space T increases each time the gear teeth grooves come on the respective communication grooves as the rotation phase advances, and the amount of hydraulic fluid (oil or the like) introduced from the respective communication grooves into the gear teeth grooves can be more acceleratively increased with the rotation. Therefore, the timing of the pressure rise in the tooth grooves at the time of high rotation can be further advanced without greatly changing the timing of the pressure rise in the tooth grooves at the time of low rotation of both the gears. As a result, in the internal gear pump, the deviation in the timing of the pressure rise in the tooth grooves between the low rotation time and the high rotation time can be further reduced.

(Section 5) As a specific aspect of the internal gear pump according to the section 4, in a relationship between the rotation phases of both the gears and the total cross-sectional area of the respective communication grooves communicating with the enclosed space, there is a bending point at which the total cross-sectional area continuously increases as the rotation phase advances and an increase rate of the total cross-sectional area changes stepwise as the rotation phase advances.

(Section 6) In the internal gear pump according to the section 4 or 5, the plurality of communication grooves may include a plurality of outer communication grooves communicating an outer enclosed space surrounded by a filler piece and the tooth grooves of the internal gears with the high pressure region, and a plurality of inner communication grooves communicating an inner enclosed space surrounded by the filler piece and the tooth grooves of the external gear with the high pressure region, each of the outer communication grooves may be formed so that the high pressure region and the outer enclosed space communicate with each other at different timings as both the gears rotate, and each of the inner communication grooves may be formed so that the high pressure region and the inner enclosed space communicate with each other at different timings as both the gears rotate.

According to the internal gear pump according to a section 6, a deviation in the timing of the pressure rise in the tooth grooves of both the internal gear and the external gear at the time of low rotation and high rotation can be reduced.

(Section 7) In the internal gear pump according to the section 6, the number of the plurality of inner communication grooves and the number of the plurality of outer communication grooves may be the same, and the plurality of inner communication grooves and the plurality of outer communication grooves may be formed such that a timing at which the inner enclosed space comes on each of the inner communication grooves and a timing at which the outer enclosed space comes on each of the outer communication grooves match with each other as the gears rotate.

According to the internal gear pump according to a section 7, a difference in the timing of the pressure increase accompanying the rotation in each tooth groove of the internal gear and the external gear can be reduced.

(Section 8) In the internal gear pump according to any one of the sections 4 to 7, each of the plurality of communication grooves may have a shape tapered from the high pressure region toward the enclosed space.

According to the internal gear pump according to a section 8, the pressure in the enclosed space can be gently increased with the rotation, and the pressure can be smoothly introduced from the high pressure region into the enclosed space.

(Section 9) In the internal gear pump according to any one of the sections 1 to 8, the communication grooves may be formed in the sealing member.

The above-described communication grooves can be formed in both the sealing member and the filler piece, for example. This filler piece is often made of a material such as brass having excellent workability, and therefore when the communication grooves are formed in the filler piece, there is a risk that the communication grooves may be scraped by a pressure of the hydraulic fluid. According to the internal gear pump according to a section 9, since the communication grooves are formed in the sealing member made of a material having abrasion resistance superior to that of the filler piece, breakage of the communication grooves due to the pressure of the hydraulic fluid can be suppressed.

(Section 10) As a specific aspect of the internal gear pump according to any one of the sections 1 to 9, the communication grooves are formed to communicate the high pressure region with the enclosed space adjacent to the high pressure region.

(Section 11) As a specific aspect of the internal gear pump according to any one of the sections 1 to 10, the communication grooves are formed so as to cross a tooth that partitions the high pressure region and the enclosed space.

(Section 12) An internal gear motor according to another aspect may include: an internal gear rotatably fitted in a body; an external gear inscribed in and meshed with the internal gear; a filler piece that partitions a liquid feeding space formed between the internal gear and the external gear into a high pressure region and a low pressure region; and a sealing member that covers both end surfaces of both the gears in a rotation axis direction and seals the liquid feeding space, in which a communication groove for communicating an enclosed space surrounded by the filler piece and a tooth groove of at least one of the gears with the low pressure region is formed, and the communication groove is formed such that a cross-sectional area communicating with the enclosed space continuously increases and an increase rate thereof acceleratively increases as a rotation phase of both the gears advances.

According to the internal gear motor according to a section 12, since the communication grooves are formed such that the cross-sectional area communicating with the enclosed space continuously increases and the increase rate acceleratively increases as the rotation phase of both the gears advances, the amount of hydraulic fluid (oil or the like) led out from the tooth grooves of the gears to the low pressure region through the communication grooves can be acceleratively increased with the rotation. Therefore, the timing of the pressure decrease in the tooth grooves at the time of high rotation can be significantly advanced without significantly changing the timing of the pressure decrease in the tooth grooves at the time of low rotation of both the gears. As a result, in the internal gear motor, the difference in the timing of the pressure drop in the tooth groove between the low rotation and the high rotation can be reduced.

In addition, the present invention is not limited to the above embodiment, and it goes without saying that various modifications can be made without departing from the gist of the present invention.

INDUSTRIAL APPLICABILITY

According to the internal gear pump or the internal gear motor of the present invention described above, the difference in the timing of the pressure change in the tooth groove between the time of low rotation and the time of high rotation can be reduced.

REFERENCE SIGNS LIST

100 internal gear pump, internal gear motor
1 body
11 side wall
2 internal gear
21 tooth groove
3 external gear
31 tooth groove
4 filler piece
41 outer peripheral surface
42 inner peripheral surface
5 sealing member (side plate)
51 communication port
6 communication groove
61 side edge
$\mathbf{6}_o$ outer communication groove
$\mathbf{6}_i$ inner communication groove
7 front cover
8 rear cover
9 drive shaft
$P_i$ inlet
$P_o$ outlet
S liquid feeding space $R_H$ high pressure region
$R_L$ low pressure region
$T_o$ outer enclosed space
$T_i$ inner enclosed space

The invention claimed is:

1. An internal gear pump comprising:

an internal gear rotatably fitted in a body;

an external gear inscribed in and meshed with the internal gear;

a filler piece that partitions a liquid feeding space formed between the internal gear and the external gear into a high pressure region and a low pressure region; and a sealing member that covers both end surfaces of both the gears in a rotation axis direction and seals the liquid feeding space, wherein a plurality of communication grooves are formed, the plurality of communication grooves including a communication groove for communicating with an enclosed space surrounded by the filler piece and a tooth groove of at least one of the gears with the high pressure region, wherein each of the plurality of communication grooves ends in the high pressure region and has a respective start point that is configured to overlap with the enclosed space as both the gears rotate, and wherein the plurality of communication grooves are formed so that the high pressure region and the enclosed space communicate with each other at different timings as both the gears rotate, wherein the plurality of communication grooves include a plurality of outer communication grooves communicating with an outer enclosed space surrounded by the filler piece and the tooth grooves of the internal gears with the high pressure region, and a plurality of inner communication grooves communicating with an inner enclosed space surrounded by the filler piece and the tooth grooves of the external gear with the high pressure region, wherein each of the plurality of outer communication grooves is formed so that the high pressure region and the outer enclosed space communicate with each other at different timings as both the gears rotate, and each of the plurality of inner communication grooves is formed so that the high pressure region and the inner enclosed space communicate with each other at different timings as both the gears rotate, and the communication groove is formed such that a cross-sectional area communicating with the enclosed space continuously increases, wherein an increase rate of the cross-sectional area acceleratively increases as a rotation phase of both the gears advances.

2. The internal gear pump according to claim 1, wherein the communication groove has a pyramid shape tapered from the high pressure region toward the enclosed space, and at least one side of the pyramid shape has a curved shape widening outward from a tip side toward a base end side.

3. The internal gear pump according to claim 2, wherein the communication groove has a triangular pyramid shape tapered from the high pressure region toward the enclosed space, and three sides of the shape have a curved shape widening outward from the tip side toward the base end side.

4. The internal gear pump according to claim 1, wherein in a relationship between the rotation phases of both the gears and the total cross-sectional area of the respective communication grooves communicating with the enclosed space, there is a bending point at which the total cross-sectional area continuously increases as the rotation phase advances and an increase rate of the total cross-sectional area changes stepwise as the rotation phase advances.

5. The internal gear pump according to claim 1, wherein the number of the plurality of inner communication grooves and the number of the plurality of outer communication grooves are the same, and the plurality of inner communication grooves and the plurality of outer communication grooves are formed such that a timing at which the inner enclosed space comes on each of the plurality of inner communication grooves and a timing at which the outer enclosed space comes on each of the plurality of outer communication grooves match with each other as both the gears rotate.

6. The internal gear pump according to claim 1, wherein each of the plurality of communication grooves has a shape tapered from the high pressure region toward the enclosed space.

7. The internal gear pump according to claim 1, wherein the communication groove is formed in the sealing member.

8. The internal gear pump according to claim 1, wherein the communication groove is formed to allow the high pressure region and the enclosed space adjacent to the high pressure region to communicate with each other.

9. The internal gear pump according to claim 1, wherein the communication groove is formed to cross one of the teeth that partition the high pressure region and the enclosed space.

* * * * *